US005404847A

United States Patent [19]

Han

[11] Patent Number: 5,404,847

[45] Date of Patent: Apr. 11, 1995

[54] LOW NOISE LEVEL INTERNAL COMBUSTION ENGINE

[75] Inventor: Jeiwon Han, Ulsan, Rep. of Korea

[73] Assignee: Hyundai Motor Company, Seoul, Rep. of Korea

[21] Appl. No.: 204,658

[22] Filed: Mar. 2, 1994

[30] Foreign Application Priority Data

Nov. 1, 1993 [KR] Rep. of Korea ..... 93-23000

[51] Int. Cl.[6] ..... F02F 7/00

[52] U.S. Cl. ..... 123/195 R; 123/195 H

[58] Field of Search ..... 123/195 R, 195 H, 195 C

[56] References Cited

U.S. PATENT DOCUMENTS 4,213,440 7/1980 Abe et al. .
4,230,087 10/1980 Abe et al. .
4,412,516 11/1993 Hayashi .

*Primary Examiner*—Noah P. Kamen
*Attorney, Agent, or Firm*—Birch, Stewart, Kolasch & Birch

[57] ABSTRACT

The present invention provides a low noise level internal combustion engine including a cylinder block without a skirt portion, a supporting member for supporting a journal portion of the crankshaft, the supporting member being fixed to a lower end portion of the cylinder block, a shroud for suppressing an explosion sound in a cylinder and a bearing sound to be radiated out of the engine, the shroud being integrally formed with a cylinder head fixed to an upper side of the cylinder block whereby the shroud is spaced from the cylinder block. A noise insulating member is disposed between the shroud and an oil pan for increasing a flexural rigidity of the shroud and oil pan, whereby the present invention provides a low noise level internal combustion engine which can increase a flexural rigidity of a skirt portion without increasing a wall thickness of the cylinder block or using a high strength material, and provides a low noise level internal combustion engine in which a bearing cap supporting a journal portion of a crankshaft are separated from each other and assembled by a coupling member.

7 Claims, 3 Drawing Sheets

LOW NOISE LEVEL INTERNAL COMBUSTION ENGINE

BACKGROUND OF THE INVENTION

1. Field of the Invention

The present invention relates to a low noise level internal combustion engine and, more particularly, to an internal combustion engine having a multi-cylinder which can suppress engine noise transmitted to a cylinder block from a journal portion of a crankshaft at a considerably low level.

2. Description of the Related Art

Generally, in conventional reciprocating piston engines, a journal portion of a crankshaft is rotatably supported by main bearings whose upper-half parts are carried by a cylinder block.

The lower-half parts of the main bearings are carried by bearing caps.

The cylinder block is integrally provided at its bottom portion with a skirt portion. The skirt portion is bulged out to cover the rotating crankshaft with a space between the crankshaft and the skirt portion. An oil pan for reserving an engine oil is fixed to the skirt portion.

With the recent trend of higher rotation and higher output of the engine, many methods for reducing noises and vibrations of the engine have been proposed.

Since most vibrations and noises of the engine are propagated to other portions through the cylinder block portion of the engine and the bearing portions of the crankshaft, it is most important to enhance the rigidity of these parts in order to reduce the vibrations and noises.

From this point of view, a wall thickness of the cylinder block portion is increased in thickness, or formed of a high strength material to reduce the vibrations and noises. However, this proposal gives rise to another inconvenience such that the weight of the engine itself is increased.

Schemes for reducing noises and vibrations are proposed in U.S. Pat. Nos. 4,213,440, 4,230,087, and 4,412,516.

However, all of the schemes provide only the sound-insulating member-and do not provide a method which can increase a flexural rigidity of the skirt portion.

SUMMARY OF THE INVENTION

Accordingly, the present invention has been made in an effort to solve the above-described problems.

It is an object of the present invention to provide a low noise level internal combustion engine which can increase a flexural rigidity of a skirt portion without increasing a wall thickness of a cylinder block or using a high strength material.

It is another object of the present invention to provide a low noise level internal combustion engine in which a bearing cap supporting a journal portion of a crankshaft are separated from each other and assembled by a coupling means.

To achieve the above objects, the present invention provides a low noise level internal combustion engine comprising: a cylinder block without a skirt portion; supporting means for supporting a journal portion of the crankshaft, said supporting means being fixed to a lower end portion of said cylinder block; a shroud for suppressing an explosion sound in a cylinder and a bearing sound to be radiated out of the engine, the shroud being integrally formed with a cylinder head fixed to an upper side of said cylinder block whereby the shroud is spaced from the cylinder block; and noise insulating means, disposed between said shroud and an oil pan, for increasing a flexural rigidity of said shroud and oil pan.

BRIEF DESCRIPTION OF THE DRAWINGS

Further objects and other advantages of the invention will become apparent from the following description in conjunction with the attached drawings, in which.

DESCRIPTION OF THE PREFERRED EMBODIMENT

Figure 1:
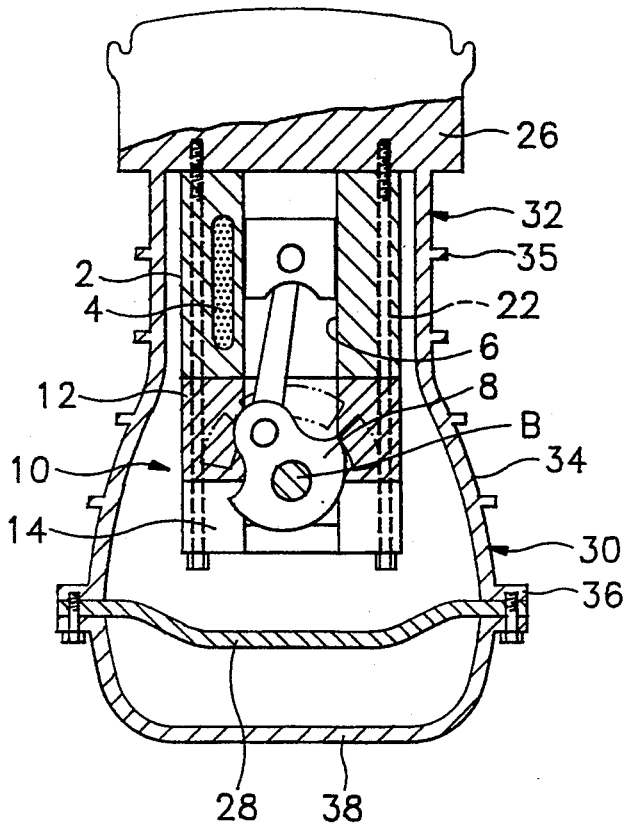
FIG. 1 is a sectional view taken in a vertical direction with respect to a longitudinal direction of a crankshaft of a low level combustion engine according to a preferred embodiment of the present invention.

Referring to FIG. 1, a cylinder block 2 generally forms a water jacket 4 for circulating a cooling water. A bore has opened upper and lower portions.

The cylinder block 2 does not have a skirt portion or a bearing cap for supporting a journal of a crankshaft which are generally formed on a conventional cylinder block.

Figure 2:
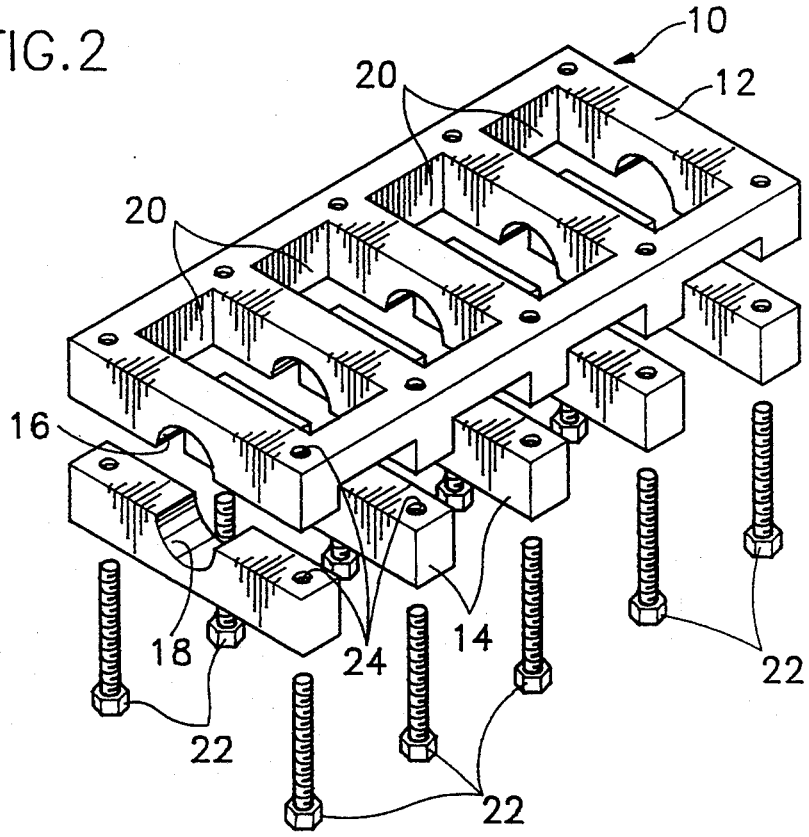
FIG. 2 is an exploded perspective view of a bearing cap of the low level combustion engine according to a preferred embodiment of the present invention.

As described above, the present invention provides the cylinder block 2 without the skirt portion or the bearing cap, and thus, the present invention provides a special supporting member 10 which serves as the skirt portion and the bearing cap, as shown in FIG. 2.

The supporting member is provided with an upper bearing cap 12 and a lower bearing cap 14. The upper and lower bearing caps have respectively bearing support portions 16, 18 having a semi-circular configuration. A journal portion 9 of a crankshaft 8 is supported between the bearing support portions 16, 18.

A plurality of rectangular holes 20 are formed at the upper half bearing cap 12 so as to provide a rotating space for a balance weight B when the crankshaft 8 rotates.

Further, elongated holes 24 are provided on the upper and lower half bearing caps 12, 14 to assemble them with each other by bolts 22.

A sound-insulating member 28 is disposed under the supporting member 10. The sound-insulating member 28 is fixed on a shroud 30 which is integrally formed with a cylinder head 26 by bolts for suppressing a vibration of the shroud 30. The shroud 30 includes an upper portion 32 slightly spaced from the cylinder block and a lower portion 34 extending widely from the upper portion.

The shroud 30 is provided at its outer side with a plurality of ribs 35 to increase a structural rigidity thereof. A boss 36 is formed on the lower end of the lower portion 34 of the shroud 30.

The sound-insulating member 28 and an oil pan 38 are fixed to the boss 36 and provided with a gasket therebetween.

Figure 3:
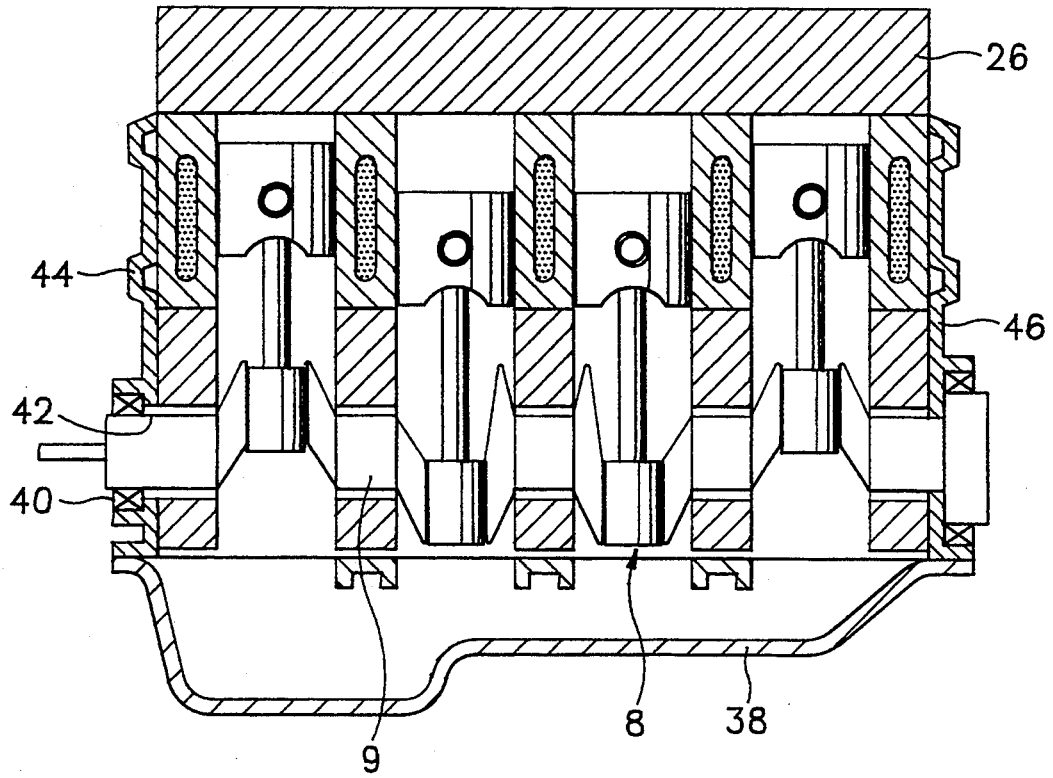
FIG. 3 is a sectional view taken in a longitudinal direction of a crankshaft of the low level combustion engine according to a preferred embodiment of the present invention.
Figure 4:
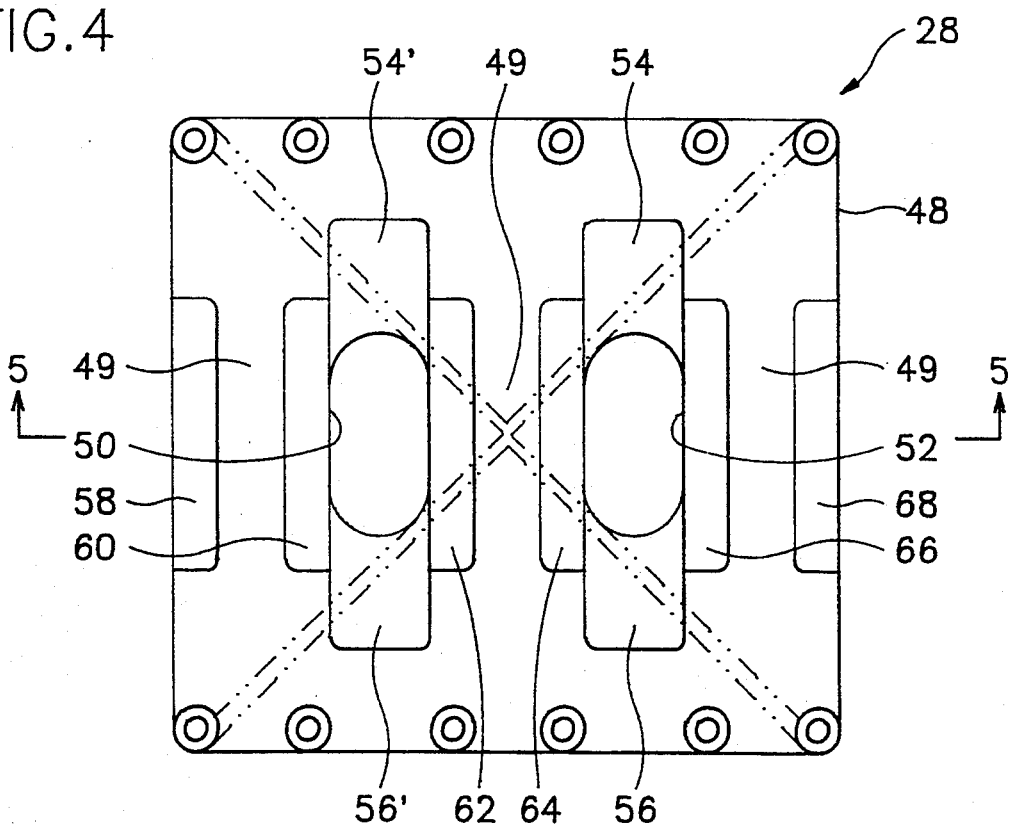
FIG. 4 is a plan view of a vibration absorption member of the low level combustion engine according to a preferred embodiment of the present invention.
Figure 5:
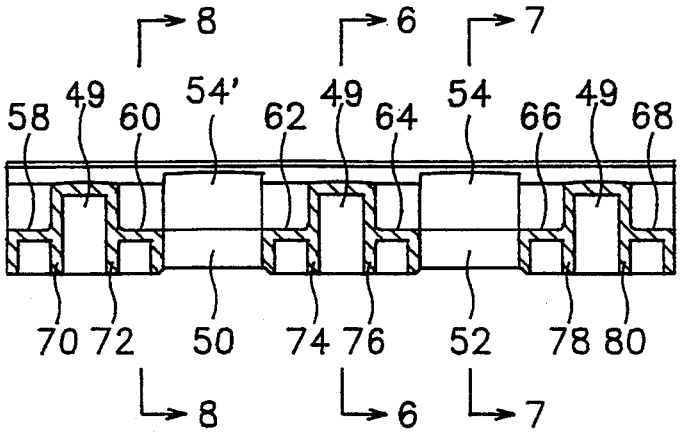
FIG. 5 is a sectional view taken along lines 5—5 of FIG. 4.

Referring to FIG. 3, a bearing 40 is located at both sides of the cylinder 2 to smoothly rotate the crankshaft penetrating the cylinder block 2.

Cases 44, 46 having a seal 42, respectively, are also mounted on both sides of the cylinder block 2, respectively, to prevent an oil leakage caused by the crankshaft 8 penetrating the cylinder block 2.

The cases 44, 46 are mounted on the cylinder block 2 by bolts and fixed at their lower end to the oil pan 38.

The sound-insulating member 28 is provided with a plate 48 and a plurality of ribs 70, 72, 74, 76, 78, and 80 integrally formed with the plate 48, as shown in FIGS. 4 through 8.

The plate 48 is provided with slits 50, 52 to exhaust oil dropped from a crank mechanism into the oil pan 38.

Both side ends of each slit 50, 52 are located between bends 54, 56 and 54', 56', respectively, which are bent from a surface of the plate downward, such that the oil from the crank mechanism is directly transmitted to the oil pan, whereby the oil can be used for lubrication.

Each slit is provided at its left and right sides with grooves 58, 60, 62, 64, 66, and 68 in a right direction with respect to a longitudinal direction of the crankshaft 8 to be lower than a surface 49 of the plate 48.

The grooves 58, 60, 62, 64, 66, and 68 are integrally formed with the ribs 70, 72, 74, 76, 78, and 80, respectively, thereby increasing flexural rigidity of the plate.

Figure 6:
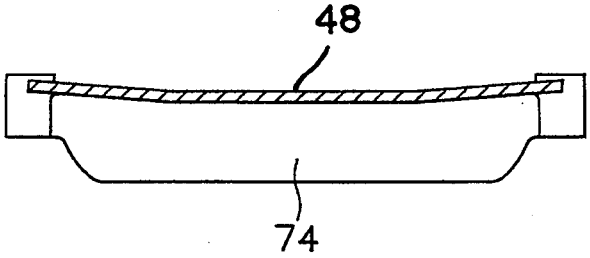
FIG. 6 is a sectional view taken along lines 6—6 of FIG. 5.
Figure 7:
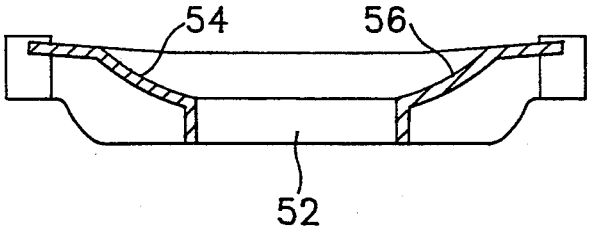
FIG. 7 is a sectional view taken along lines 7—7 of FIG. 6.

Further, as shown in FIG. 6, the plate 48 is slightly bent to effectively absorb a vibration of the shroud 30.

Figure 8:
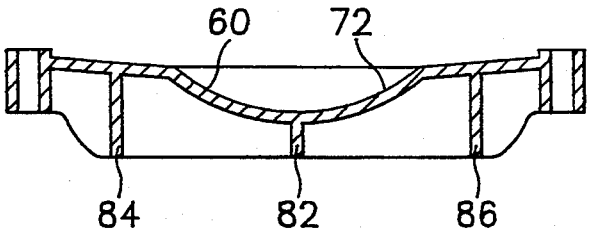
FIG. 8 is a sectional view taken along lines 8—8 of FIG. 5.

FIG. 8 is a sectional view of the grooves 58 through 68, wherein a central portion of each groove is bent downward and ribs 82, 84, and 86 are integrally formed with a bottom of each groove.

In the low noise level internal combustion engine as described above, when the crankshaft rotates by engine driving, vibration generated at the journal portion of the crankshaft 8 is transmitted to the supporting member 10 and then separately transmitted to the upper bearing cap 12 and the lower bearing cap 14.

The vibration transmitted to the upper bearing cap 12 is transmitted to the cylinder block 2. At this point, since the cylinder block is fixed to the supporting member 10 by the bolts 22, the vibration is indirectly transmitted to the cylinder block 2, thereby reducing the vibration.

Further, since the crankshaft 8 and the supporting member 10 are spaced away from the shroud 30 and the shroud 30 is integrally formed with the cylinder head 26, the vibration from the journal portion of the crankshaft 8 is reduced to a considerably low level.

Although the low level vibration acts on the lower portion of the shroud 30, since the lower portion of the shroud 30 is fixed to the noise-insulation member 28 for increasing the flexural rigidity of the shroud 30, the vibration is suppressed.

Also, since the oil pan 38 is fixed to the noise-insulation member 28, the vibration of the oil pan is suppressed.

In addition, the shroud 30 prevents the explosion sound in a cylinder from being radiated out of the engine through the cylinder block, and the plate 48 prevents the explosion sound in the cylinder and the bearing sound from being transmitted to the oil pan, thereby realizing the low noise internal combustion engine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A low noise level combustion engine comprising:

a cylinder block without a skirt portion;

a supporting means for supporting a journal of the crankshaft, said supporting means being fixed to a lower end portion of said cylinder block;

a shroud for suppressing an explosion sound in a cylinder and a bearing sound to be radiated out of the engine, the shroud being integrally formed with a cylinder head fixed to an upper side of said cylinder block whereby the shroud is spaced from the cylinder block; and noise insulating means, disposed between said shroud and an oil pan, for increasing a flexural rigidity of said shroud and oil pan and decreasing noise.

2. The combustion engine of claim 1, wherein the shroud includes an upper portion aligned with said cylinder block, a lower expanded portion extending from said upper portion, and a plurality of ribs integrally formed with the upper and lower portions of the shroud to increase the rigidity thereof.

3. The combustion engine of claim 1, wherein said supporting means includes an upper bearing cap having a plurality of rectangular holes formed therethrough for providing a rotating space of balance weights of the crankshaft and a lower bearing cap connected with the upper bearing cap by a bolt.

4. (Amended) The combustion engine of claim 1, wherein said noise-insulating means is formed with a plate which is bent with respect to a longitudinal direction of the crankshaft.

5. The combustion engine of claim 4, wherein said plate comprises a slit for transmitting oil from a crank mechanism to the oil pan, and a plurality of grooves formed on both sides of the slit to be lower than a surface of the plate for increasing structural rigidity.

6. The combustion engine of claim 4, wherein said plate includes a plurality of ribs integrally formed therewith for increasing structural rigidity.

7. The combustion engine of claim 1, wherein side walls of the cylinder block are each provided with a casing member having a seal formed therein to surround the journal of the crankshaft.

* * * * *